US011114799B2

(12) United States Patent
Schoedel et al.

(10) Patent No.: US 11,114,799 B2
(45) Date of Patent: Sep. 7, 2021

(54) HOUSING FOR A PLUG COMPRISING A DISPLAY UNIT

(71) Applicant: TE Connectivity Germany GmbH, Bensheim (DE)

(72) Inventors: Maximilian Schoedel, Mannheim (DE); Samir Aboulkassem, Griesheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/878,132

(22) Filed: May 19, 2020

(65) Prior Publication Data

US 2020/0373709 A1 Nov. 26, 2020

(30) Foreign Application Priority Data

May 21, 2019 (DE) ..... 102019113491.9

(51) Int. Cl.
*H01R 13/627* (2006.01)
*H01R 13/502* (2006.01)
(Continued)

(52) U.S. Cl.
CPC ..... *H01R 13/6275* (2013.01); *H01R 13/502* (2013.01); *H01R 13/6272* (2013.01); *H01R 13/639* (2013.01); *H01R 13/641* (2013.01)

(58) Field of Classification Search
CPC ..... H01R 13/641; H01R 13/6275; H01R 13/502; H01R 13/6272; H01R 13/639
(Continued)

(56) References Cited

U.S. PATENT DOCUMENTS 6,109,955 A * 8/2000 Hanazaki ..... H01R 13/641 439/352
8,016,606 B1 * 9/2011 Kwan ..... H01R 13/641 439/352
(Continued)

FOREIGN PATENT DOCUMENTS

DE 102007033942 A1 1/2009
DE 102013006830 A1 1/2014
(Continued)

OTHER PUBLICATIONS

German Office Action, dated Jan. 22, 2020, 6 pages.
(Continued)

*Primary Examiner* — Gary F Paumen
(74) *Attorney, Agent, or Firm* — Barley Snyder

(57) ABSTRACT

A housing includes a display unit indicating a complete plugging of a counter-plug into the housing and a first stop. The display unit is movable along a longitudinal axis between an initial position and an assembly position. The display unit includes a locking element, a guide element, and a supporting element. The locking element has a resilient bridge with a first end fixed to the guide element. The first stop prevents the display unit from moving in the initial position by abutment with a free end of the bridge. The free end is bent in a bending plane in a direction of the guide element when moving toward the first stop. The supporting element supports the bridge at the guide element when the bridge deforms in the direction of the guide element and prevents a deformation of the bridge away from the abutment on the first stop.

20 Claims, 10 Drawing Sheets

(51) Int. Cl.
*H01R 13/639* (2006.01)
*H01R 13/641* (2006.01)

(58) Field of Classification Search
USPC ..... 439/489, 352
See application file for complete search history.

(56) References Cited

U.S. PATENT DOCUMENTS

| | | | | |
|---|---|---|---|---|
| 8,926,355 | B2 | 1/2015 | Heil et al. | |
| 9,300,084 | B2 | 3/2016 | Wimmer | |
| 2002/0009923 | A1* | 1/2002 | Kashiyama | H01R 13/641 439/595 |
| 2008/0139035 | A1* | 6/2008 | Kim | H01R 13/6272 439/352 |
| 2012/0282791 | A1* | 11/2012 | Brown | H01R 13/639 439/157 |
| 2014/0287614 | A1 | 9/2014 | Nakajim et al. | |
| 2017/0025792 | A1* | 1/2017 | Horiuchi | H01R 13/639 |
| 2017/0062983 | A1* | 3/2017 | Holub | H01R 13/6271 |
| 2017/0250502 | A1* | 8/2017 | Endo | H01R 13/641 |
| 2018/0034201 | A1* | 2/2018 | Sekino | H01R 13/62 |
| 2019/0115695 | A1* | 4/2019 | Miyamura | H01R 13/64 |

FOREIGN PATENT DOCUMENTS

| | | | |
|---|---|---|---|
| DE | 102013205447 | A1 | 10/2014 |
| DE | 102015103898 | U1 | 10/2015 |
| EP | 3208893 | A2 | 8/2017 |

OTHER PUBLICATIONS

Abstract of DE102007033942, dated Jan. 29, 2009, 1 page.
Abstract of DE102015103898, dated Sep. 22, 2016, 1 page.
Communication—The Extended European Search Report dated Sep. 24, 2020 in Appln. 20175247.4-1201, 8 pages.

* cited by examiner

HOUSING FOR A PLUG COMPRISING A DISPLAY UNIT

CROSS-REFERENCE TO RELATED APPLICATION

This application claims the benefit of the filing date under 35 U.S.C. § 119(a)-(d) of German Patent Application No. 102019113491.9, filed on May 21, 2019.

FIELD OF THE INVENTION

The present invention relates to a housing for a plug and, more particularly, to a housing for a plug having a display unit.

BACKGROUND

Housings for a plug have a display unit indicating that a counter-plug has been completely plugged in.

SUMMARY

A housing includes a display unit indicating a complete plugging of a counter-plug into the housing and a first stop. The display unit is movable along a longitudinal axis between an initial position and an assembly position. The display unit includes a locking element, a guide element, and a supporting element. The locking element has a resilient bridge with a first end fixed to the guide element. The first stop prevents the display unit from moving in the initial position by abutment with a free end of the bridge. The free end is bent in a bending plane in a direction of the guide element when moving toward the first stop. The supporting element supports the bridge at the guide element when the bridge deforms in the direction of the guide element and prevents a deformation of the bridge away from the abutment on the first stop.

BRIEF DESCRIPTION OF THE DRAWINGS

The invention will now be described by way of example with reference to the accompanying Figures, of which:

FIG. 9 is a schematic partial depiction of the housing with the counter-plug completely plugged in;

DETAILED DESCRIPTION OF THE EMBODIMENT(S)

Figure 1:
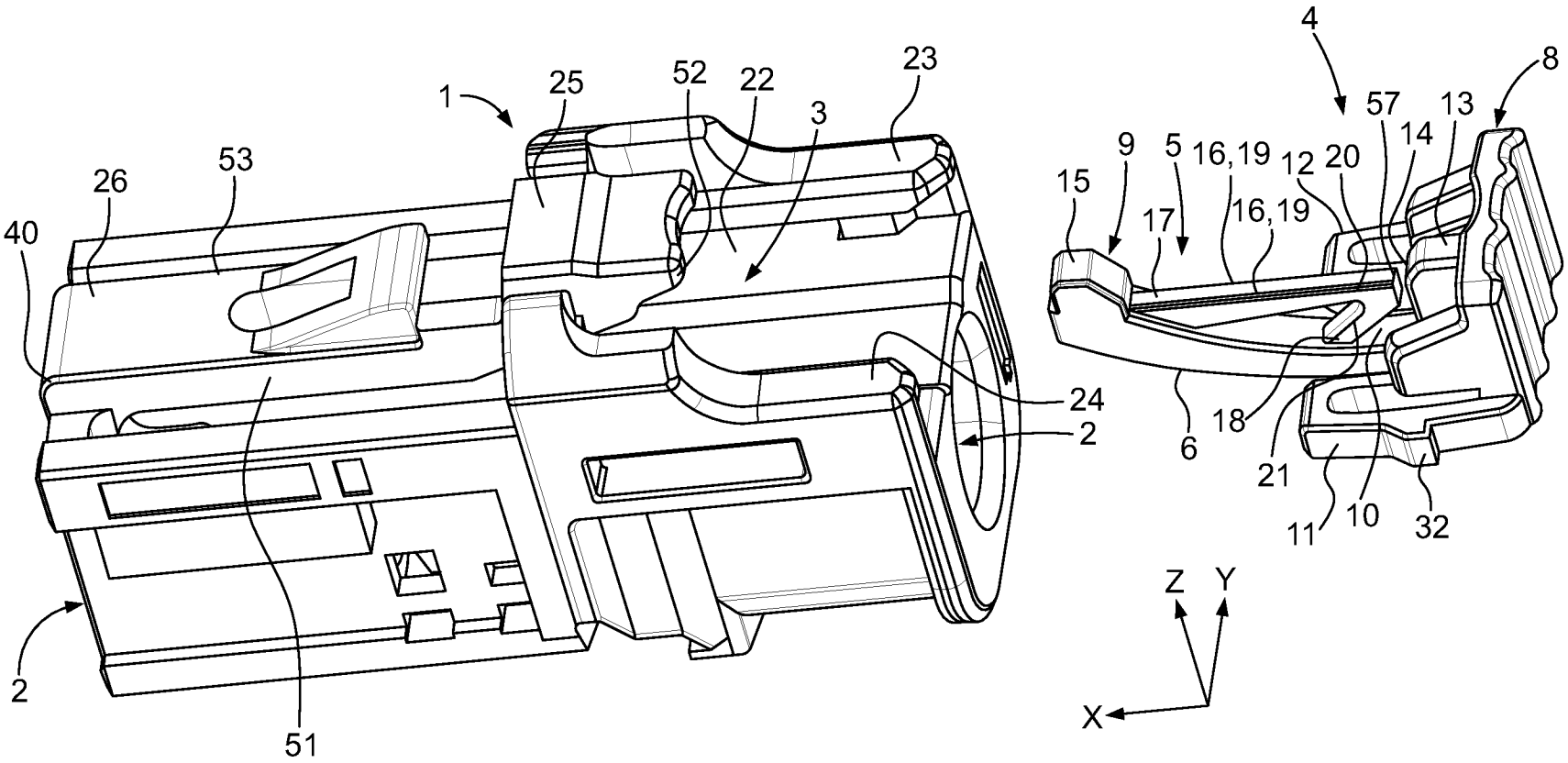
FIG. 1 is a perspective view of a housing and a display unit according to an embodiment.

In the following, the invention is explained in greater detail with reference to the accompanying drawings, in which exemplary embodiments are shown. In the figures, the same reference numerals are used for elements that correspond to one another in terms of their function and/or structure. According to the description of the various aspects and embodiments, elements shown in the drawings can be omitted if the technical effects of those elements are not needed for a particular application, and vice versa: i.e. elements that are not shown or described with reference to the figures but are described above can be added if the technical effect of those particular elements is advantageous in a specific application.

A housing 1 for a plug according to an embodiment, to form a plugging connection with a further housing, is shown in FIG. 1. The housing 1 has a contact space 2 open on both sides, with contacts, in particular electrical contacts, being able to be provided in the contact space 2. The housing 1 is formed to be plugged together with a further housing of a counter-plug to form a contact connection.

A display unit 4 according to an embodiment is shown in FIG. 1. The display unit 4 is provided to indicate complete plugging of the counter-plug into the housing 1. The display unit 4 has a guide element 8 and a locking element 5. The guide element 8 is connected to the locking element 5 and, in an embodiment, is integrally formed with the locking element 5. The locking element 5 has a resilient bridge 6. A first end 10 of the bridge 6 is firmly connected or fixed to the guide element 8. A second end 9 of the bridge 6 is formed as a free end 9 and spaced apart from the guide element 8. In an embodiment, the first end 10 of the bridge 6 is arranged closer to a central axis of the housing 1 than the free end 9 of the bridge 6. In this manner, the bridge 6 has an orientation which defines a bending plane. Depending on the selected embodiment, the bridge 6 may have, at least in sections, a shape which is bent outwards in the bending plane away from a central axis of the housing 1, or a straight shape directed outwards.

The guide element 8, as shown in FIG. 1, has two guiding structures 11, 12 on the sides. The guiding structures 11,12 have laterally outwardly protruding engagement elements 32, 33. In addition, the guide element 8 has a blocking section 13 in the center. On the blocking section 13, an abutment surface 14 is formed on a side facing the bridge 6. The blocking section 13 is arranged on a plane with the bridge 6. The guide element 8, in an embodiment, is mirror-symmetrical relative to a central plane.

An engagement section 15 is formed on the second end 9 of the bridge 6, as shown in FIG. 1. The bridge 6 has a further bridge 16. The further bridge 16 constitutes a supporting element arranged between the bridge 6 and the guide element 8. The further bridge 16 is fixed to the bridge 6 by a first further end 17 adjacent to the engagement section 15. A second further end 18 of the further bridge 16 is arranged at the bridge 6 close to the first end 10 of the bridge 6. In an embodiment, the further bridge 16 is connected to the bridge 6 at the first further end 17 and the second further end 18.

As shown in FIG. 1, the further bridge 16 has a first section 19, which extends starting from the first further end 17 in the direction of the guide element 8. The first section 19 merges into a second section 21 via a bend 20. In the depicted embodiment, the first section 19 is arranged straight starting from the first further end 17 in the direction of the guide element 8. Via the bend 20, the further bridge 16 is guided downwards via the second section 21 in the direction of the bridge 6 and somewhat set back in the direction of the first further end 17. The bend 20 is thus arranged closer to the guide element 8 than the second further end 18 of the further bridge 16. The bend 20 has a further abutment surface 57 facing the guide element 8. In this manner, the first section and the second section of the further bridge 16 delimit an angle which is smaller than 90°. The further bridge 16 can have a smaller cross-section than the bridge 6. Depending on the design chosen, the first and the second sections 19, 21 can also form different angles which are larger than 90° or smaller than 90°.

Above the contact space 2, as shown in FIG. 1, the housing 1 has a guiding space 3 for receiving the display unit 4. The guiding space 3 is delimited by an upper side 22 of the housing 1, two further side walls 23, 24 and a housing section 25. The housing section 25 is arranged opposite, and spaced apart from, the upper side 22. The first and second further side walls 23, 24 are formed laterally at opposing edge regions of the upper side 22.

The housing section 25 is connected, in particular integrally connected, to a second end 40 of the housing 1 in an end region 26. In an embodiment, the end region 26 is a narrow strip end. In addition, the housing section 25 is formed, at three further sides 51, 52, 53, freely and spaced apart from the housing 1. The housing section 25 extends along a longitudinal axis of the housing 1, i.e. along a plug-in direction of the further housing onto the housing 1. The housing section 25 is formed resiliently via the one-sided connection at the end region 26 in a manner which allows it to be deformed in the direction of a center of the housing 1.

Figure 2:
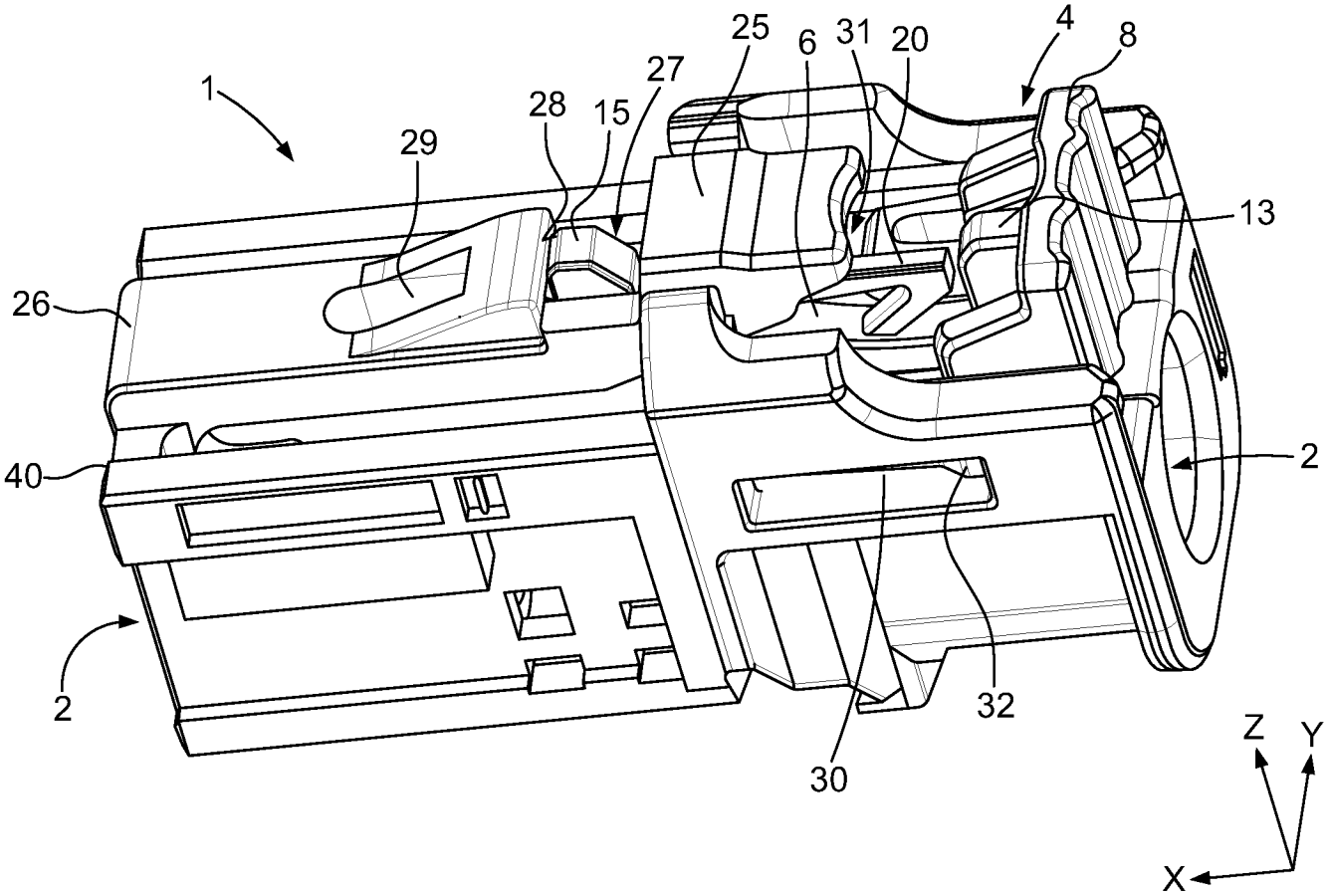
FIG. 2 is a perspective view of the display unit mounted on the housing in an initial position.

FIG. 2 shows the housing 1 with the display unit 4, which is situated in an initial position and which is borne movably on the housing 1 in a manner allowing it to be shifted along a longitudinal axis of the housing 1. The longitudinal axis of the housing 1 is located in the x-direction of the depicted coordinate system. For longitudinal guiding, the further side walls 23, 24 have corresponding lateral recesses 30, 31 which engage the first and the second guiding structures 11, 12. The guide element 8 is thus also reliably fixed to the housing and borne to be shiftable in the longitudinal direction.

The housing section 25 has a first recess 27 through which the engagement section 15 of the locking element 5 protrudes, as shown in FIG. 2. Adjacent to the first recess 27, a first stop 28 is formed at the housing section 25. The engagement section 15 abuts on the first stop 28. Thus the display unit 4 can be shifted, from the depicted initial position, no further along the x-direction in the direction of the second end 40 of the housing 1. The housing section 25 additionally has a second recess 29, which is arranged closer to the second end 40 of the housing 1 than the first recess 27 along the x-direction.

Figure 3:
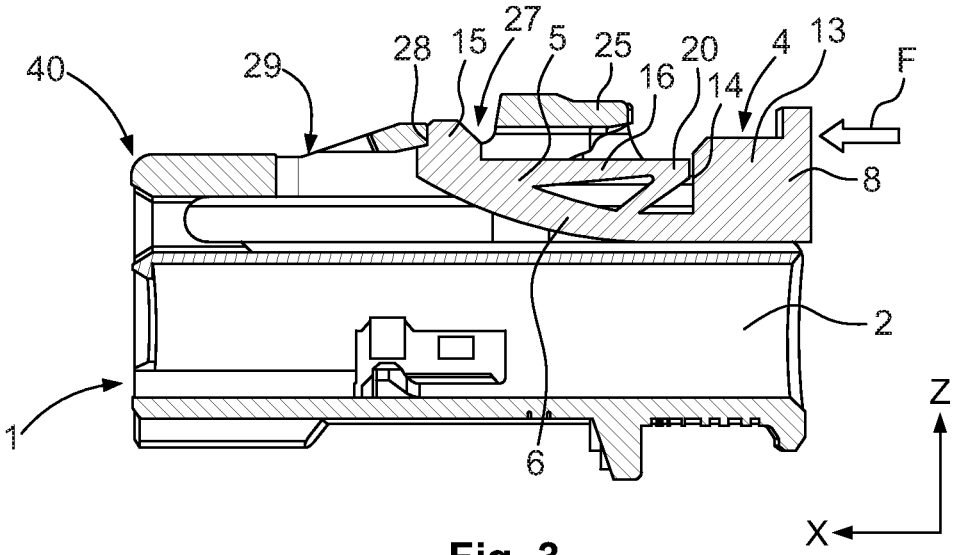
FIG. 3 is a sectional side view of the arrangement in FIG. 2.

FIG. 3 shows a schematic cross-section through the housing 1 according to FIG. 2. As shown in FIG. 3, the guide element 8 is acted upon by a force F which attempts to move the display unit 4, starting from the present initial position, in the direction of the second end 40 of the housing 1, into an assembly position. In this case, the engagement section 15 of the locking element 5 is supported against the first stop 28 of the housing 1. As a result, the engagement section 15 is bent somewhat upwards in the z-direction away from a center of the housing 1. Consequently, the supporting element, which is formed in the shape of the further bridge 16, comes into abutment on the abutment surface 14 of the blocking section 13 of the guide element 8 in the region of the bend 20. Further bending of the bridge 6 is thus blocked by the abutment of the further bridge 16 on the guide element 8. Thus, despite the great flexibility of the bridge 6, it can be ensured, with the aid of the further bridge 16, that even large forces F cannot deform the bridge 6 so strongly that the engagement section 15 slips downwards out of the first recess 27 and is moved downwards away from the first stop 28 and triggers a movement of the display unit 4 along the X axis.

Figure 4:
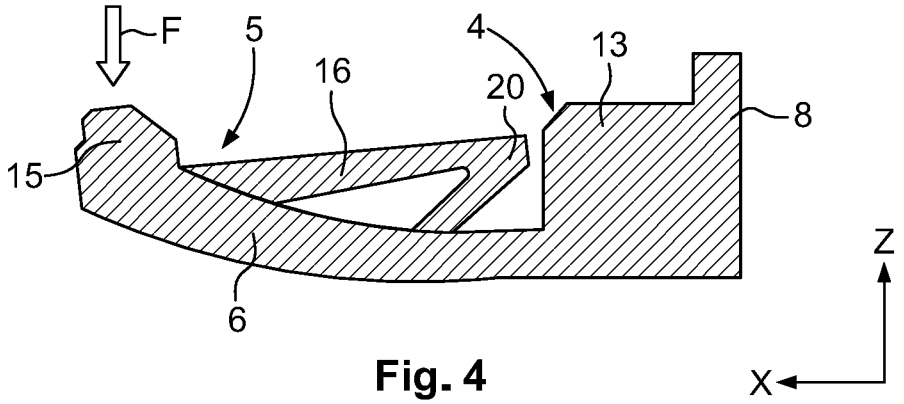
FIG. 4 is a sectional side view of the display unit with a locking element in an activation position.

FIG. 4 shows a schematic depiction of the display unit 4 with a force F, which acts in the direction of the arrow toward the free end of the bridge 6. It can be seen here that the engagement section 15, due to the great flexibility of the bridge 6, can be moved downwards out of the rest state with little force. A bending plane in which the locking element 5 can be moved is arranged in the z-x plane.

Figure 5:
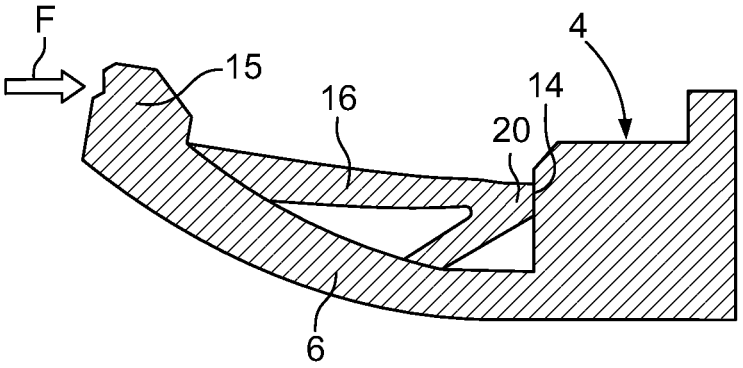
FIG. 5 is a sectional side view of the display unit with the locking element stressed in a blocking direction.

FIG. 5 shows the engagement section 15 being acted upon by a force F, depicted in the form of the arrow, in a situation according to FIG. 3 in which the engagement section 15 abuts on the first stop 28 of the housing, and in which the display unit 4 nevertheless is intended to be moved from the initial position into an assembly position by applying a force F. In this situation, the bridge 6 is bent in the bending plane, i.e. in the z-x plane, in a blocking direction toward the guide element 8. In this case, the further bridge 16 comes into abutment on the blocking section 13. Thus, even with high forces F, a further deformation of the bridge 6, and thus a further shift of the engagement section 15 away from the first stop, is prevented. The stability of the locking element 5 is thus significantly increased with the aid of the further bridge 16 in the blocking direction.

Thus, depending on the locking element 5 direction of bending, different rigidities can be provided for the movement of the locking element 5, without the rigidity of the bridge 6 per se being altered. As a result, the bridge 6 may be formed to be relatively thin and flexible and nevertheless a high locking force with the locking element 5 against shifting of the display unit 4 into the assembly position, without a completely plugged-in counter-plug, may be provided.

Figure 6:
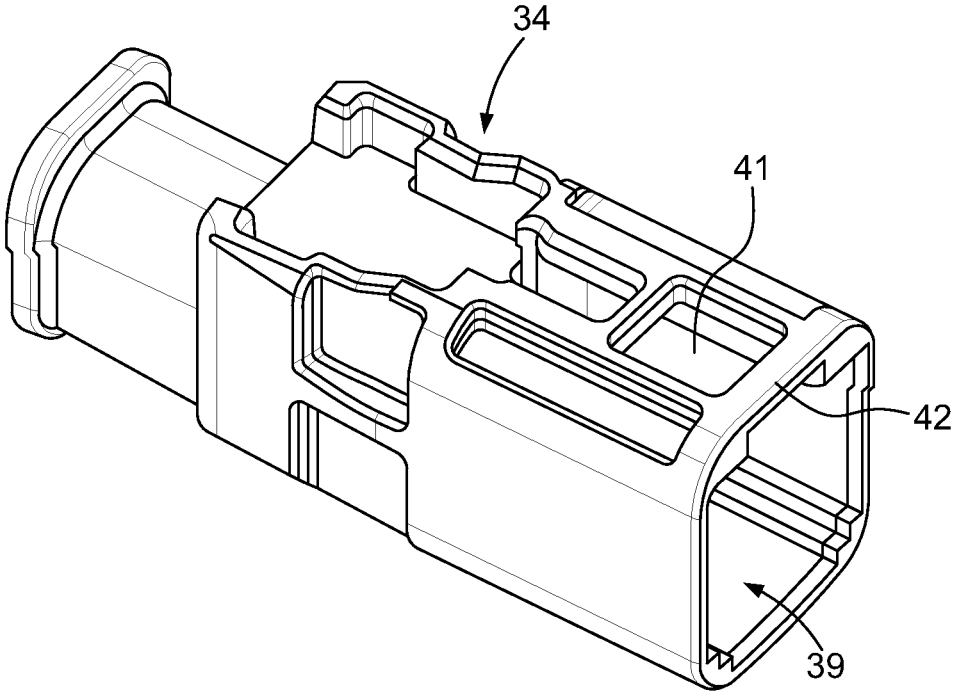
FIG. 6 is a perspective view of a further housing of a counter-plug.

FIG. 6 shows a schematic depiction of a further housing 34 of a counter-plug. The further housing 34 has a receiving aperture 39, into which the second end 40 of the housing 1 is pushed during assembly. On an upper side, the further housing 34 has a further first recess 41. In this manner, an actuation strip 42 is formed on the front side. When the two housings 1, 34 are in the completely plugged state, the engagement section 15 is arranged in the further first recess 41 and is thus freely accessible for an actuation. Electrical and/or any other type of contacts can be arranged in the further housing 34. In addition, the further housing 34 can be provided with electrical cables or any other type of cables, in particular with optical cables, which are connected to the contacts of the further housing 34.

Figure 7:
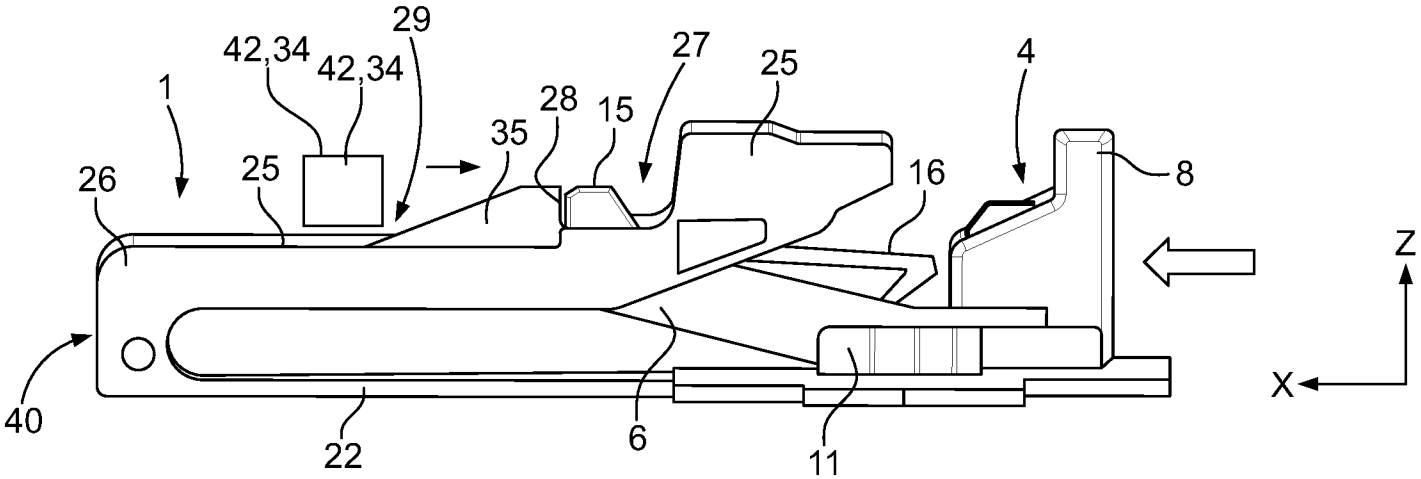
FIG. 7 is a schematic partial depiction of the housing inserted into the counter-plug.

FIG. 7 shows a schematic depiction of a partial cut-out of the housing 1 which is being pushed into the receiving aperture 39 of the further housing 34 of a counter-plug by the second end 40. To simplify the depiction, only a cut-out of the housing 1 and a cross-section of the actuation strip 42 are depicted. During assembly, the actuation strip 42 of the further housing 34 slides on the upper side of the housing section 25 in the direction of the first recess 27. The housing section 25 has a ramp-like section 35, which is arranged between the first and the second recesses 27, 29. The ramp-like section 35 has, in the direction of the first recess 27, a height which increases in the z axis.

Figure 8:
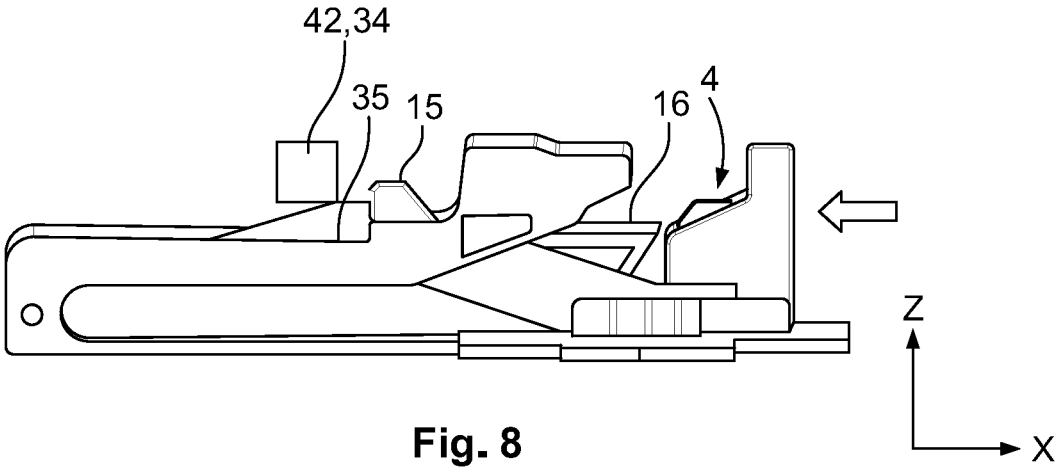
FIG. 8 is a schematic partial depiction of the housing with a partially plugged in counter-plug.

FIG. 8 shows the situation in which the actuation strip 42 of the further housing 34 is pushed over the ramp-like section 35. Because the housing section 25 is formed in an elastically resilient manner, the housing section 25 is pressed downwards in the direction of a center of the housing 1. The housing section 25 is flexible in the direction of the bending plane of the bridge 6.

Figure 9:
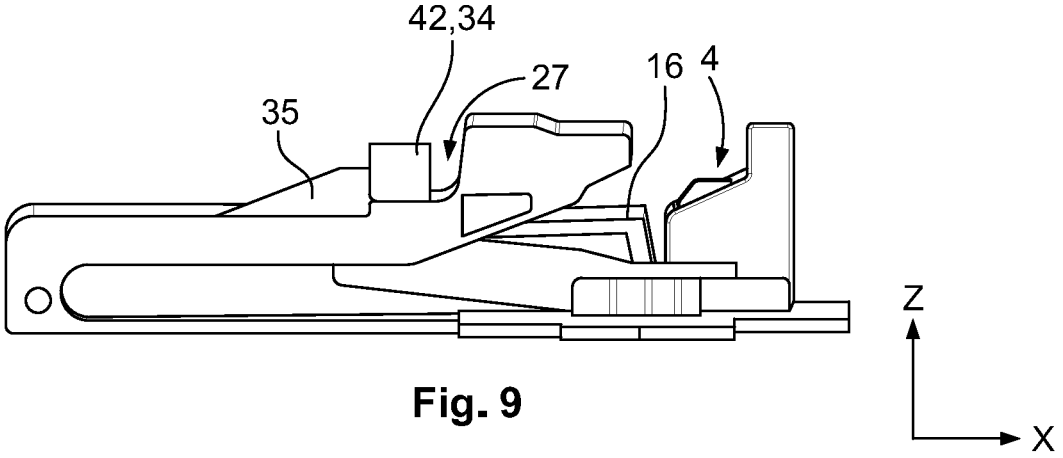

FIG. 9 shows the situation in which the further housing 34 is arranged over the first recess 27. The housing section 25 is sprung back into the initial position again as in FIG. 7. Simultaneously, the free end of the locking element 5, i.e. the engagement section 15 has been deflected out of the rest state in the direction of a center of the housing 1, as schematically depicted in FIG. 4. In this case, the bridge 6 has been bent downwards in the direction of a center of the housing 1.

In the situation shown in FIG. 9, the engagement section 15, along the z axis, is arranged underneath the first stop 28 in an activation position. In this state of the engagement section 15, the display unit 4 can be shifted along the x axis in the direction of the second recess 29. In this situation, the further housing 34 of the further plug is completely plugged onto the housing 1. In this position, electrical contacts of the housing 1 and electrical contacts of the further housing 34, for example, can be arranged in a desired contact position. In addition, in this situation, sealing regions between the housing 1 and the further housing 34 can be situated in an optimum position. Only in this plugging position is it possible to move the display unit 4 from the initial position into an assembly position, for example by a manual actuation of the guide element 8. In this case, the engagement section 15 slides through under the first stop 28 in the direction of the second recess 29. When the second recess 29 is reached, the locking element 5 springs into a rest state again, as depicted in FIG. 10.

Due to the limited possibility of deflection of the locking element 5 in the locking direction, as is depicted in FIG. 5, a small overlap between the engagement section 15 and the first stop 28 is already sufficient to block a movement of the display unit 4. The display unit 4 is thus only released when the further housing 34 is situated precisely in the desired plugging position and the engagement section 15 is completely deflected inwards by the first stop 28 in the direction of a center of the housing 1.

Figure 10:
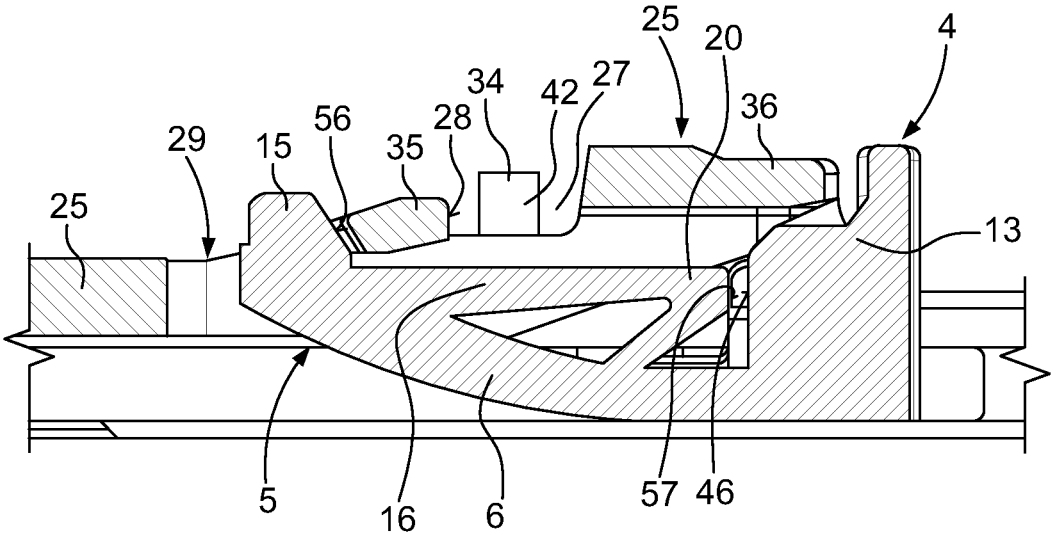
FIG. 10 is a sectional side view of the housing with the counter-plug completely plugged-in and a display unit pushed into an assembly position.

As shown in FIG. 10, in the assembly position, the display unit 4, with the blocking section 13, is situated under a free end section 36 of the housing section 25. In addition, the further housing 34 is arranged in the region of the first recess 27 and engages behind the first stop 28. To pull the further housing 34 off of the housing 1, it would be necessary to press the housing section 25, and in particular the ramp-like section 35, in the direction of a center of the housing 1. However, this is not possible in the depicted position of the display unit 4, because the free end section 36 rests on an upper side of the blocking section 13 and thus the housing section 25 cannot be moved in the direction of a center of the housing 1. In addition, the engagement section 15 of the locking element 5 engages in the second recess 29. The second engagement section is blocked by a second stop 56, which in the housing section 25 adjacent to the second recess 29 and adjacent to the ramp-like section 35 against pulling back in the direction of the first recess 27.

If it is intended to pull the further housing 34 of the further plug off of the housing 1 again, the engagement section 15 of the locking element 5 is pressed by a tool or by hand in the direction of a center of the housing 1 and at the same time a force is introduced at the guide element 8, which force moves the display unit 4 from the assembly position back into the initial position again. If the display unit 4 is situated in the initial position again, the housing section 25 can be pressed in the direction of the center of the housing 1, such that the actuation strip 42 can be pulled away from the housing 1 over the first stop 28 and the ramp-like section 35.

Figure 11:
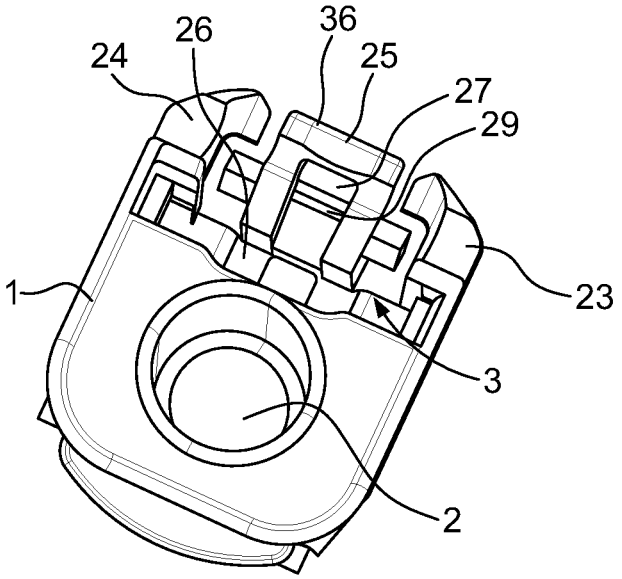
FIG. 11 is a perspective view of the housing.

FIG. 11 shows a perspective depiction of a view of the housing 1 which does not depict the display unit 4. In this depiction, it can be clearly seen that the housing section 25 is formed as an elongate section which is connected to the housing 1 only at a narrow side in the end region 26. A movable housing section 25 is thus simply provided.

Figure 12:
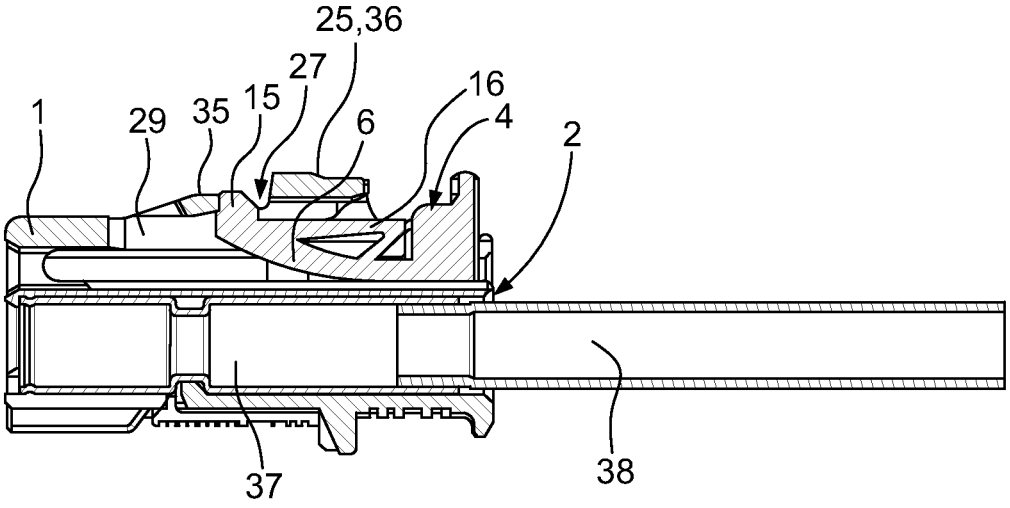
FIG. 12 is a sectional side view of the housing with a contact and a cable.

FIG. 12 shows a schematic cross-section of an embodiment of the housing 1, in which an electrical contact 37 is assembled with an electrical cable 38. Instead of electrical contacts and electrical cables, any other type of contacts and any other type of cable, for example, such as a light conductor, can be mounted on the housing 1. In the case of light conductors, it is also possible to dispense with the contacts.

FIGS. 13-17 show various embodiments of the display units 4 with various forms of the locking element 5.

Figure 13:
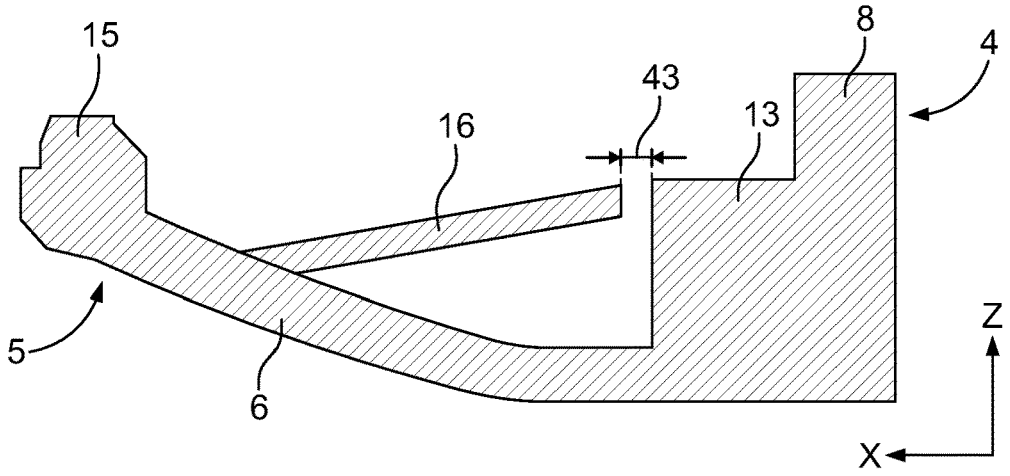
FIG. 13 is a sectional side view of the locking element according to another embodiment.

In the embodiment of the display unit 4 in FIG. 13, the supporting element is formed in the shape of a simple further bridge 16, which extends starting from the bridge 6 in a straight direction toward the guide element 8 of the display unit 4 and ends in a defined spacing 43 in front of the blocking section 13 or abuts on the blocking section 13. Thus, in this embodiment too, the locking element 5 can be moved in the bending plane, i.e. in the x-z plane, away from the guide element 8 with a small amount of force. In the direction toward the guide element 8, i.e. in the blocking direction, the engagement section 15 can be moved with a small amount of force only until the spacing 43 is bridged. If the further bridge 16 abuts on the guide element 8, the further bridge 16 impedes the further deformation of the bridge 6 in the direction of the guide element 8.

Figure 14:
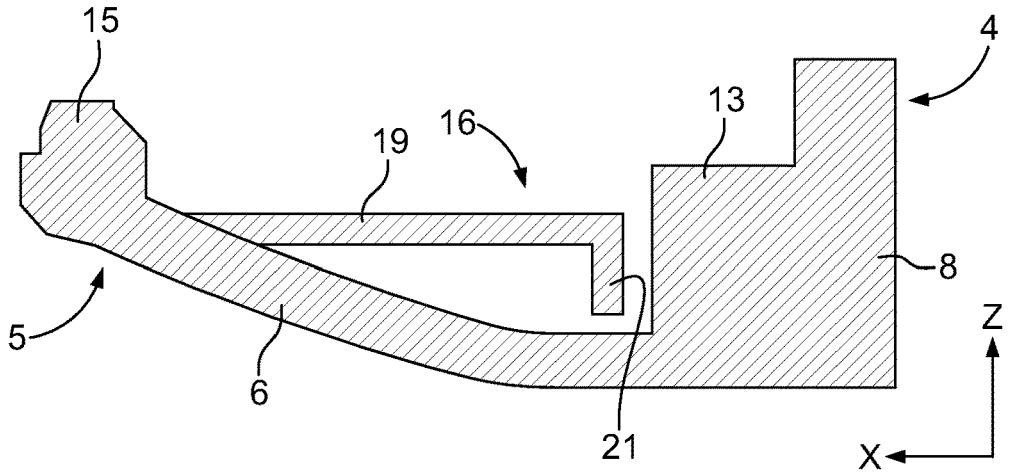
FIG. 14 is a sectional side view of the locking element according to another embodiment.

FIG. 14 shows a further embodiment of the locking element of the display unit 4, with the supporting element in this embodiment being formed as a bent-down further bridge 16 comprising a first section 19 and a second section 21. In this embodiment, an end of the second section 21 is not connected to the bridge 6, but rather is formed as a free end. In addition, in this embodiment the first and the second sections 19, 21 are arranged at a 90° angle. However, in this embodiment too, the first and the second sections 19, 21 can also form angles smaller or larger than 90°. The mode of operation is similar to the previously described examples, wherein the further bridge 16 causes the bridge 6 to be supported on the guide element 8 when the bridge 6 deforms in the direction of the guide element 8.

Figure 15:
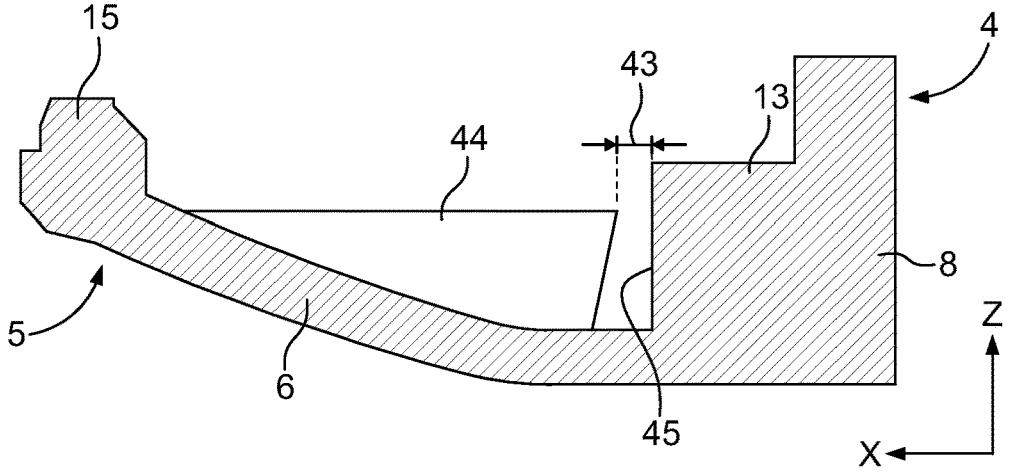
FIG. 15 is a sectional side view of the locking element according to another embodiment.

FIG. 15 shows a further embodiment of the display unit 4, with the supporting element being formed in this embodiment in the form of a plate 44 molded onto the bridge 6. The plate 44 is formed between the bridge 6 and a support surface of the guide element 8. In the rest position of the bridge 6, the plate 44 has a specified spacing 43 from the supporting surface of the guide element 8 or abuts on the guide element 8 with a lateral surface. If the bridge 6 is deformed in the direction of the guide element 8, the plate 44 comes into abutment on the supporting surface 45 and blocks a further deformation of the bridge 6. Depending on the embodiment selected, the plate 44 may also have recesses, in order to save material, without reducing the rigidity of the plate 44 below a specified value.

Figure 16:
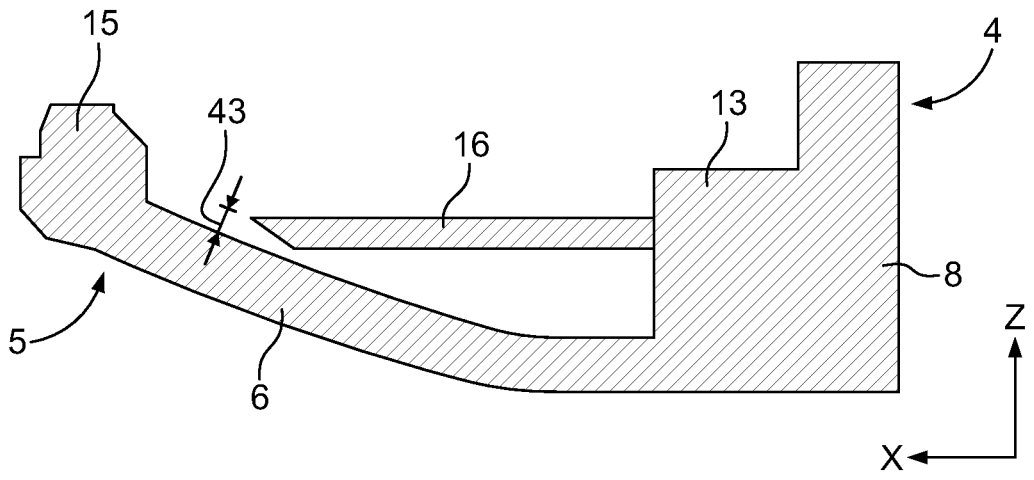
FIG. 16 is a sectional side view of the locking element according to another embodiment.
Figure 17:
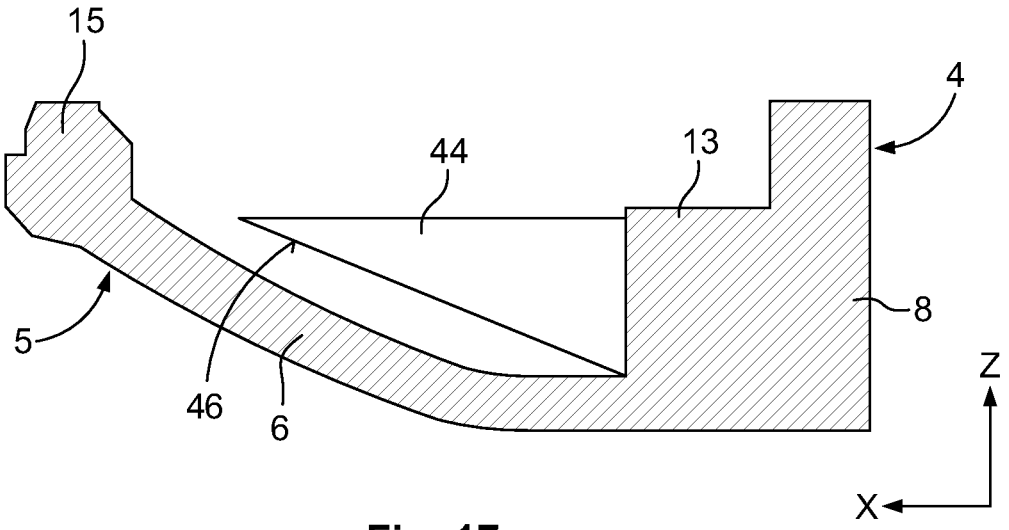
FIG. 17 is a sectional side view of the locking element according to another embodiment.

FIGS. 16 and 17 schematically show exemplary embodiments in which the supporting element is formed on the guide element 8 itself.

In FIG. 16, a further bridge 16 is guided from the guide element 8 in the direction of the bridge 6 of the locking element 5. In the rest state of the bridge 6, a free end of the further bridge 16 has a specified spacing 43 from the bridge 6. If the bridge 6 is deformed in the x-z plane bending plane in the direction of the guide element 8, the bridge 6 comes into abutment on the free end of the further bridge 16. A further deformation of the bridge 6 in the direction of the guide element 8 is thus blocked.

FIG. 17 shows a further embodiment in which the supporting element is formed in the shape of a plate 44 or a block on the guide element 8. When the bridge 6 is in the resting position, a further abutment surface 46 of the plate 44 has a specified spacing 43 from the bridge 6 or abuts on the bridge 6. If the bridge 6 is bent in the direction of the locking element 5, the bridge 6 comes into abutment on the further abutment surface 46 of the plate 44, in a front end region of the plate 44. In this embodiment too, the bridge 6 is blocked from moving any further in the direction of the locking element 5. The plate 44 may likewise have recesses.

In all embodiments, the supporting elements, in cross-section relative to a longitudinal extent, have a smaller material thickness in at least one direction than the bridge 6. With the aid of the supporting element which is arranged between the bridge 6 of the locking element and a further section of the display unit 4 in a bending plane of the bridge 6, a bending of the bridge 6 in a locking direction is increased without altering the flexibility of the bridge 6 in the bending plane counter to the locking direction.

Both the display unit 4 and the housing 1 can be made of plastic. The supporting element and the display unit 4 are also monolithically formed in a single piece in an embodiment. The display unit 4 constitutes a housing position assurance, which is also called a CPA (Connector Position Assurance), with which a correct testing of the correct plugging position of the housing with the further housing 34 can be tested. The housing 1 and the further housing 34 can represent a connector device for electrical or optical signals, for example.

The housing 1 and the further housing 34 can have not only one, but rather also a number of contacts and/or cables. In addition, depending on the selected embodiment, it is possible for not only one display unit 4, but rather also a number of display units, to be arranged on the housing 1.

Figure 18:
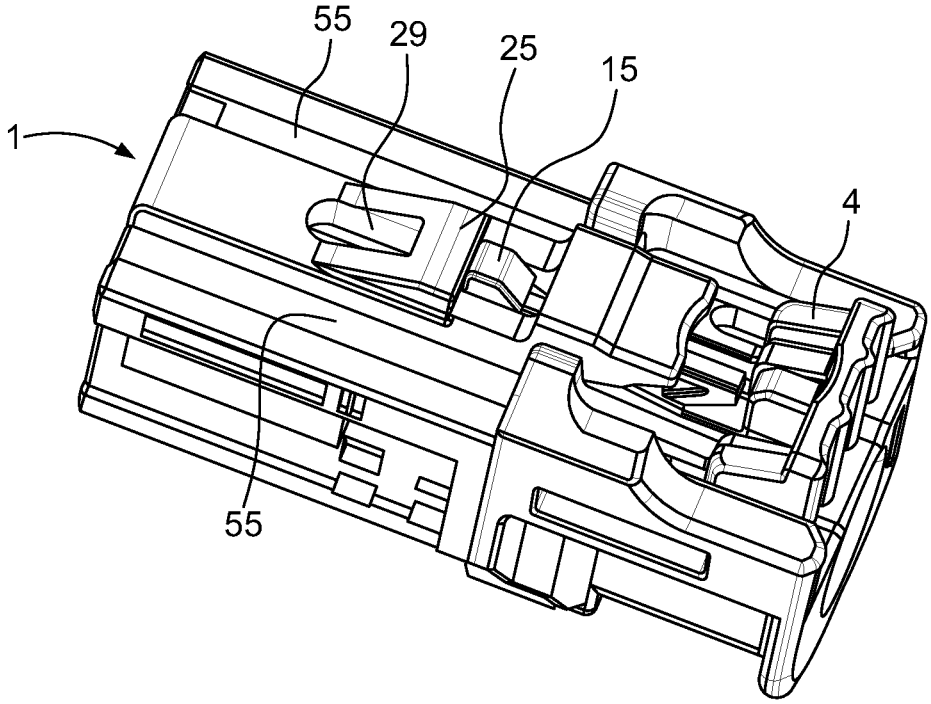
FIG. 18 is perspective view of a housing according to another embodiment.

FIG. 18 shows a schematic depiction of a top view of a further embodiment of the housing 1, in which the housing section 25 is flexibly connected to the housing 1. In this embodiment, in contrast to the embodiments described hitherto, the housing section 25 is not exposed on three sides, but rather is connected to the housing 1 on three sides. The flexibility of the housing section 25 is created for example by correspondingly thinned connecting sections 55 for example in the side region of the housing section 25 with the housing 1.

The display unit 4 can be released out of a locked state with little force by the completely plugged-in counter-plug, but at the same time the display unit 4 is secured, very stably and with a high amount of locking force, against any shifting of the display unit 4 into an assembly position without the counter-plug being completely plugged in.

What is claimed is:

1. A housing for a plug having a contact space for contacts, comprising:

a display unit indicating a complete plugging of a counter-plug into the housing, the display unit is movable along a longitudinal axis of the housing between an initial position and an assembly position, the display unit including a locking element, a guide element, and a supporting element, the locking element has a resilient bridge with a first end fixed to the guide element; and a first stop preventing the display unit from moving in the initial position by abutment of a free end of the bridge on the first stop, the free end is bent in a bending plane in a direction of the guide element when moving in a direction of the first stop, the supporting element is arranged in the bending plane between the bridge and the guide element, the supporting element supports the bridge at the guide element when the bridge deforms in the direction of the guide element and prevents a deformation of the bridge away from the abutment on the first stop.

2. The housing of claim 1, wherein the locking element is deformed from a rest state into an activation position by an actuation strip of the counter-plug when the housing is completely plugged together with the counter-plug.

3. The housing of claim 2, wherein a moving of the display unit into the assembly position is triggered when the locking element is in the activation position, the locking element springs back into the rest state after the display unit has been moved into the assembly position.

4. The housing of claim 3, wherein movement of the display unit is blocked by abutment of the locking element on a second stop of the housing when the locking element is in the rest state in the assembly position.

5. The housing of claim 1, wherein the supporting element is formed as a further bridge extending from the bridge toward a supporting surface of the guide element.

6. The housing of claim 1, wherein the supporting element is formed on the guide element and extends toward the locking element.

7. The housing of claim 5, wherein the further bridge has a first further end and a second further end both connected to the bridge.

8. The housing of claim 5, wherein the further bridge has a first section extending toward the guide element and a second section merging with the first section via a bend, the second section extends at least partially toward the bridge.

9. The housing of claim 8, wherein the first section and the second section delimit an angle less than 90° at the bend, the second section extends toward the free end of the bridge at least partly away from an abutment surface of the guide element.

10. The housing of claim 9, wherein the bend has a further abutment surface facing the abutment surface of the guide element, the further abutment surface abuts the abutment surface and supports the bridge at the guide element when the bridge deforms.

11. The housing of claim 1, further comprising a housing section flexible in the bending plane, the housing section has a first recess, the free end of the bridge is arranged in the first recess in the initial position.

12. The housing of claim 11, wherein the first stop is formed adjacent to the first recess at the housing section.

13. The housing of claim 12, wherein the housing section extends along the longitudinal axis of the housing and has an elongate strip form with a narrow strip end integrally connected to the housing.

14. The housing of claim 13, wherein the housing section is free on three sides and spaced apart from the housing, the housing section is resilient and deformable in a direction of a center of the housing.

15. The housing of claim 14, wherein the housing section has a second recess, the free end of the bridge engages in the second recess in the assembly position.

16. The housing of claim 15, wherein the guide element has a blocking section arranged under the housing section in the assembly position and blocking a deformation of the housing section in the direction of the center of the housing.

17. The housing of claim 12, wherein the counter-plug has an actuation strip engaging in the first recess in a completely plugged state, the actuation strip moves the free end of the bridge out of a rest state in a direction of a center of the housing, moving the free end of the bridge away from the first stop, the actuation strip engages behind the first stop.

18. The housing of claim 1, wherein the first end of the bridge is closer to a central axis of the housing than the free end of the bridge.

19. The housing of claim 1, wherein the bridge has, at least in sections, a shape which is bent outwards in the bending plane away from a central axis of the housing, or the bridge has, at least in sections, a straight shape directed outwards in the bending plane away from the central axis.

20. The housing of claim 1, wherein the bridge, in a smallest cross-section, has a greater width and/or a greater height than the supporting element.

* * * * *